US005086720A

United States Patent [19]

Gibran

[11] Patent Number: 5,086,720

[45] Date of Patent: Feb. 11, 1992

[54] FURNACE FOR CONTROLLABLE COMBUSTION OF THERMITE

[76] Inventor: Kahlil Gibran, 160 W. Canton St., Boston, Mass. 02118

[21] Appl. No.: 645,639

[22] Filed: Jan. 25, 1991

[51] Int. Cl.[5] ..... F23B 7/00

[52] U.S. Cl. ..... 110/234; 110/349

[58] Field of Search ..... 110/233, 234, 349; 122/18, 15, 20 R

[56] References Cited

U.S. PATENT DOCUMENTS

| | | |
|---|---|---|
| 1,417,075 | 5/1922 | La Cour et al. . |
| 1,506,323 | 8/1924 | O'Neill . |
| 1,606,322 | 11/1926 | Scrive . |
| 2,289,007 | 7/1942 | Gessler . |
| 2,744,742 | 5/1956 | Lord . |
| 2,953,443 | 9/1960 | Lloyd . |
| 2,971,097 | 2/1961 | Corbett . |
| 3,047,057 | 7/1962 | Carlyle . |
| 3,322,515 | 5/1967 | Dittrich et al. . |
| 3,516,880 | 6/1970 | Johnson . |
| 3,588,303 | 6/1971 | Karrer . |
| 3,738,288 | 6/1973 | Brandenberger . |
| 3,874,365 | 4/1975 | Pava . |
| 4,043,314 | 8/1977 | Trumble et al. . |
| 4,047,942 | 9/1977 | Clark et al. . |
| 4,050,680 | 9/1977 | Sweeney . |
| 4,331,475 | 5/1982 | Perfect . |
| 4,593,528 | 6/1986 | Bailey . |
| 4,881,472 | 11/1989 | Stromberger et al. ..... 110/349 |
| 4,881,677 | 11/1989 | Amos et al. . |
| 4,889,324 | 12/1989 | Brosnan et al. . |
| 4,926,797 | 5/1990 | Butler ..... 110/234 |
| 4,976,208 | 12/1990 | O'Connor ..... 110/234 |
| 4,976,209 | 12/1990 | Piggin ..... 110/234 |

*Primary Examiner*—Henry C. Yuen

*Attorney, Agent, or Firm*—Weingarten, Schurgin, Gagnebin & Hayes

[57] ABSTRACT

The invention provides a furnace for the controllable combustion of thermite. In an exemplary embodiment, the invention comprises a furnace housing having a combustion chamber into which thermite, in the form of rods, wires, or ribbons of encapsulated pellets, may be fed by an automatic feeder. An electric arc within the housing ignites the thermite. Coils embedded in the furnace housing circulate fluids for drawing off the energy product of thermite combustion beyond the furnace housing for utilization. The rate of combustion may be controlled by use of a vented flue, an adjustable feeder, and by cutter edges which snip the thermite to prevent further burning. The furnace housing contains insulation for retaining combustion heat product so that heat retained by the housing may continue to be drawn off by the coils. The invention provides a compact and thermally efficient furnace for diverse energy purposes, such as home heating or producing steam for driving turbine generators.

23 Claims, 1 Drawing Sheet

FURNACE FOR CONTROLLABLE COMBUSTION OF THERMITE

FIELD OF THE INVENTION

The present invention relates to a power production system, and more particularly to a furnace for controlling the combustion of thermite.

BACKGROUND OF THE INVENTION

Thermite, also referred to as thermit, is a metallic composition of an oxide and aluminum powder. The oxide is typically of iron or magnesium, and may be of other metal. Thermite, as its name implies, provides an extremely exothermic reaction. It offers a compact fuel substance inasmuch as solid metal fuel and solid carburent are intimately mixed. However, the thermite reaction is difficult to control, due in part to the high amounts of heat energy released, which further serves to ignite the fuel, and due to the rapid rate at which the metal fuel is consumed by the combustion. It is used in welding and in incendiary bombs.

Numerous methods have been employed for initiating the combustion of thermite. One known method involves burning metal wires or bars by combusting gases around the metal. In U.S. Pat. No. 2,744,742 there is disclosed the use of a nozzle for introducing combustible gases, such as acetylene, to the vicinity of metal fuel wire. It is not disclosed, however, how the heat produced from the resultant combustion of metal is retained or controlled.

Other methods of combusting thermite include the use of gunpowder (See e.g., in U.S. Pat. No. 2,744,742) and the use of an electrical ignition. The use of an electric spark and percussion cap is suggested for the ignition of thermite in U.S. Pat. No. 1,506,323, which discloses an exothermic apparatus that controls the rate of combustion of metal fuel by providing a mixture of a metal fuel and a normally solid carburent in a "mushy condition" to a combustion chamber. Thermite is used merely to bring the system to operative condition, and is not used as the primary fuel. The apparatus disclosed, moreover, is complicated and bulky.

In view of the foregoing disadvantages, what is needed is a compact and efficient furnace for initiating and controlling the combustion of thermite in a solid, dry form.

SUMMARY OF THE INVENTION

The present invention provides a compact and efficient furnace for controlling the combustion of thermite in dry and compact form. In one embodiment of the invention, the thermite furnace comprises an insulated housing in which water or steam pipe coils are embedded. Thermite, in wire, rod, or plastic encapsulated pellets in ribbon form, is fed by an automatic feeder into the combustion chamber within the insulated housing, and combustion is initiated by an electric arc. The rate of combustion may, for example, be regulated by altering the speed of the automatic feeder.

The present invention is economical in that it does not require the constant combustion of thermite. Thermite burns at such a high temperature that relatively short lengths of wire, rods, or ribbons are required to elevate the combustion chamber to a sufficient temperature such that the fluid contained in the coils may be heated. An optional cutter, located at or within the furnace wall, cuts the wire, rod, or ribbon to terminate burning. Heat retained by the insulated housing, however, may continue to heat the water coils without the need for the constant and wasteful combustion of thermite. In a further embodiment of the invention, an inert gas may be introduced into the combustion chamber to facilitate the transfer and distribution of heat within the chamber.

DESCRIPTION OF THE DRAWINGS

The attendant advantages and features of the invention will be readily understood by reference to the following detailed description when considered in conjunction with the accompanying drawing wherein.

DETAILED DESCRIPTION OF THE INVENTION

Figure 1:
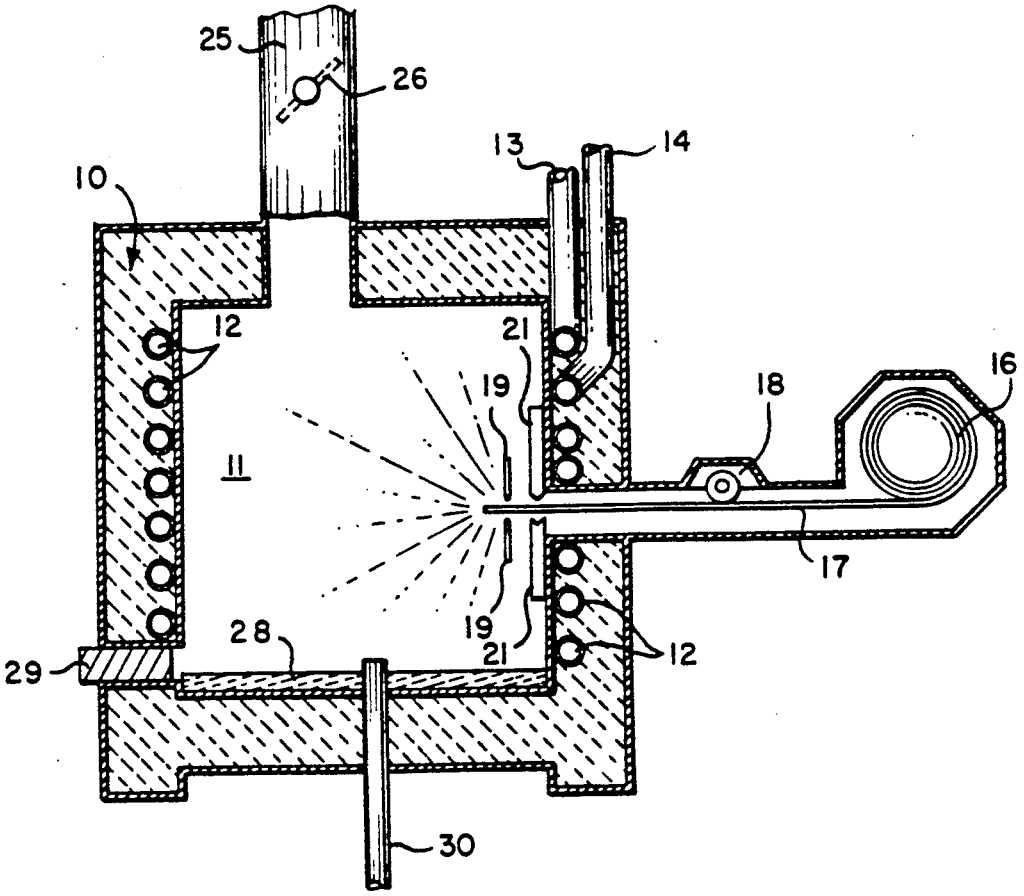
FIG. 1 is a representational view of a compact furnace for initiating and controlling the combustion of thermite fuel in wire, rod, or ribbon form.

FIG. 1 shows an exemplary embodiment of the thermite furnace of the present invention. A furnace housing 10 is insulated to prevent the uncontrolled escape of the heat energy which results from combustion. The housing may be constructed from materials commonly used for such purposes, such as concrete, ceramics, or cement bricks. Coils 12 for circulating a fluid such as water or steam are embedded within the housing 10 and provide for the removal of the heat product of combustion. A coil inlet pipe 13 and outlet pipe 14 may be connected to an external pump (not shown) or other device for circulating the fluid within the pipes. The inlet pipe 13 and outlet pipe 14 provide for connection of the heated coils 12 to utilization devices, such as steam generators or heating pipes which, for example, may be used for heating a home.

Thermite may be introduced into the combustion chamber in the form of wire, rods, or ribbons, as generally designated at 17. Thermite may be formed into the shape of pellets embedded in or attached to a carrier ribbon, such as a thermoplastic tape, which is preferably comprised of a material that self-extinguishes. As to methods of introducing metal wires and ribbons into a combustion zone, reference is made to U.S. Pat. No. 3,047,057, which is incorporated herein by reference. The thermite 17 of the present invention may be accordingly stored on a reel or spool, as generally designated at 16, or by similar means of storage, and introduced into the combustion chamber 11 by an automatic pull feeder 18.

In a further embodiment of the invention in which thermite is used in wire form, thermite wire 17 may be fed into the combustion chamber by commercially available pull feeders. One such commercial pull feeder is manufactured and sold by Airco Corporation. Thus, in one embodiment of the invention, thermite 17 may be fed into the furnace by an AIRCOMATIC (Reg. TM) Model AHF-NP pull feeder, which was designed for delivering metal wire to an arc to be ignited for pulsed spray welding purposes. The use of such commercially available feeders may facilitate the operation of different embodiments of the invention to the extent that the use of various wire diameters are permitted. Such commercially available feeders also offer control and smooth introduction of the wire into the combustion chamber 11 because they are usually designed in the context of pulse spray welding purposes to provide smooth and consistent delivery of wire regardless of an operator's manipulation of the metal fuel wires.

Thermite 17 fed into the combustion chamber 11 may be ignited by an electric arc 19, in one embodiment of the invention, and the combustion may be terminated by optional cutters, as shown generally at 21.

A flue 25 with a vent control 26 enables the heat contained within the combustion chamber 11 to be controlled. A thermostat may be used to regulated the vent control 26 and automatic wire feeder 18 in a further embodiment of the invention.

Thermite 17 is preferably introduced into the combustion chamber 11 through the side of the housing 10 so that resultant heat of combustion may circulate upwards and around the inside of the chamber 11. An inert gas may be introduced into the combustion chamber 11 through an inlet or pipe, as shown at 30, to provide a medium for facilitating the distribution of combustion energy over the inner walls of the housing 10 which contain the heat transfer coils 12. The vented emissions, consisting essentially of water and oxygen, are expected to be negligible.

The floor of the housing may contain a carbon slab 28, while a clean-out port 29 may be located near the bottom of the combustion chamber for the removal of ashes or other byproducts.

Figure 2:
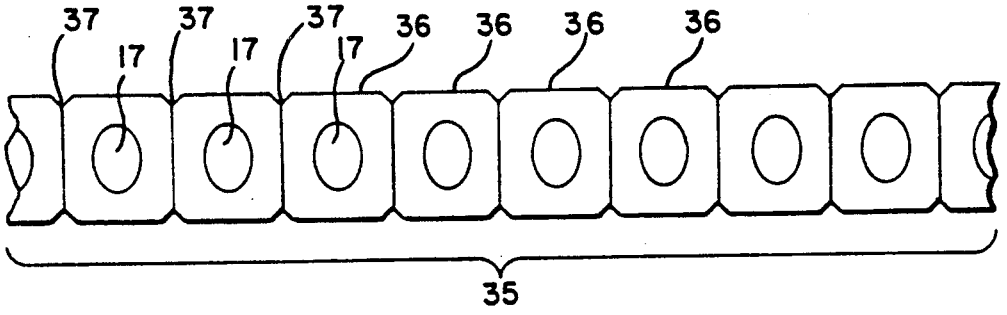
FIG. 2 is a top representational view of thermite in encapsulated pellets in ribbon form.

As shown in FIG. 2, the introduction of thermite into the combustion chamber may be accomplished by encapsulating thermite 17 into a ribbon 35 which, in a preferred embodiment, is comprised of a plurality of serially connected compartments 36 separated by break points 37. The compartmented ribbon 35 may be made of self-extinguishing material that is pliable enough to permit the ribbon to be stored and pulled off of a roll. The introduction of encapsulated thermite into the combustion chamber may render further benefits in terms of controlling the rate of combustion.

A variety of modifications and variations of the invention is possible. Thus, it is to be understood that the present invention can be practiced otherwise than as specifically described herein.

What is claimed is:

1. A furnace for initiating and controlling the combustion of thermite, comprising:

a furnace housing having a combustion chamber and insulation for retaining the heat product of combustion;

a means for introducing thermite into said combustion chamber;

an electric arc located within said furnace housing for igniting into combustion thermite fed into said chamber;

means for cutting the thermite fed into said chamber; and coil means for circulating fluid within said housing around said combustion chamber for drawing off the heat energy of thermite combustion beyond said housing for utilization.

2. The furnace of claim 1 wherein the means for introducing thermite into said combustion chamber comprises thermite wire.

3. The furnace of claim 1 wherein the means for introducing thermite into said combustion chamber comprises thermite in rod form.

4. The furnace of claim 1 wherein the means for introducing thermite into said combustion chamber comprises thermite in ribbon form.

5. The furnace of claim 1 wherein the means for introducing thermite into said combustion chamber comprises thermite in encapsulated form, said encapsulated thermite being connected so as to form a ribbon suitable for storage of the thermite in a roll.

6. The furnace of claim 5 wherein the encapsulated thermite is placed into the encapsulations in equal amounts.

7. The furnace of claim 5 wherein the encapsulated thermite is in pellet form.

8. The furnace of claim 5 wherein said rollable encapsulated thermite is further comprised of break points located between each of said encapsulations.

9. The furnace of claim 1 wherein said furnace housing is made of concrete.

10. The furnace of claim 1 wherein said furnace housing is made of fire brick lined with heat treatment ceramic shielding.

11. The furnace of claim 1 wherein said means of introducing thermite into said combustion chamber further comprises a spool and a pull feeder.

12. The furnace of claim 1 further comprising a flue having a controllable vent.

13. The furnace of claim 1 further comprising an inlet for providing an inert gas into said combustion chamber.

14. The furnace of claim 1 wherein said coil means is connected to a steam turbine.

15. The furnace of claim 1 further comprising a port located near the bottom of the combustion chamber for removing ash and other combustion products.

16. The furnace of claim 6 wherein said pull feeder is controlled by a thermostat.

17. The furnace of claim 7 wherein said vent is controlled by a thermostat.

18. A furnace for initiating and controlling the combustion of thermite, comprising:

a furnace housing having a combustion chamber and insulation for retaining the heat product of combustion;

encapsulated thermite in ribbon form for introducing controlled amounts of thermite into said chamber;

a pull feeder for feeding said encapsulated thermite into said chamber; an electric arc located within said furnace housing for igniting into combustion said encapsulated thermite fed into said chamber;

means for cutting the thermite fed into said chamber; and coil means for circulating fluid within said housing around said combustion chamber for drawing off the heat energy of thermite combustion beyond said housing for utilization.

19. The furnace of claim 18 wherein said coil means is connected to a steam turbine.

20. A furnace for initiating and controlling the combustion of thermite, comprising:

a furnace housing having a combustion chamber and insulation for retaining the heat product of combustion;

thermite encapsulated in self-extinguishing material;

a means for introducing said thermite into said combustion chamber;

an electric arc located within said furnace housing for igniting into combustion the encapsulated thermite fed into said chamber;

coil means disposed within said further housing, within said housing insulation, and around said combustion chamber, said coil means operative to circulate fluid within said housing around said combustion chamber and for drawing off the heat energy of thermite combustion beyond said housing for utilization; and said encapsulated thermite being shaped in a solid elongated form sufficient to enable said thermite to be continuously introduced into said combustion chamber and positioned within said combustion chamber at a point whereat it is ignited by said electric arc.

21. The furnace of claim 20 wherein said thermite is encapsulated in equal amounts.

22. The furnace of claim 20 wherein said thermite is encapsulated in plastic.

23. The furnace of claim 20 wherein said coil means is connected to a steam turbine.

* * * * *

UNITED STATES PATENT AND TRADEMARK OFFICE

CERTIFICATE OF CORRECTION

PATENT NO. : 5,086,720

DATED : February 11, 1992

INVENTOR(S) : Kahlil Gibran

It is certified that error appears in the above-identified patent and that said Letters Patent is hereby corrected as shown below:

Column 4, line 17, "brick lined with heat treatment" should read --brick lined with heat resistant--.

Signed and Sealed this

Sixth Day of July, 1993

Attest:

Michael K. Kirk

MICHAEL K. KIRK

Attesting Officer

Acting Commissioner of Patents and Trademarks